United States Patent [19]

Tharpe

[11] Patent Number: 4,922,624

[45] Date of Patent: May 8, 1990

[54] METHOD AND APPARATUS FOR DRYING LUMBER

[76] Inventor: John M. Tharpe, 2606 Northgate Rd., Albany, Ga. 31707

[21] Appl. No.: 270,254

[22] Filed: Nov. 14, 1988

[51] Int. Cl.[5] ..... F26B 21/06

[52] U.S. Cl. ..... 34/29; 34/46; 34/54; 34/191; 34/218

[58] Field of Search ..... 34/44, 46, 48, 50, 51, 34/53, 54, 55, 26, 30, 34, 29, 191, 218

[56] References Cited

U.S. PATENT DOCUMENTS

| | | | |
|---|---|---|---|
| 1,624,754 | 4/1927 | Mueller | 34/29 |
| 3,386,183 | 6/1968 | Reynolds | 34/48 |
| 3,744,144 | 7/1973 | Weis | 34/29 X |
| 4,356,641 | 11/1982 | Rosenau | 34/48 X |
| 4,599,808 | 7/1986 | Gelineau et al. | 34/48 X |

*Primary Examiner*—Harry B. Tanner

*Attorney, Agent, or Firm*—Jones, Askew & Lunsford

[57] ABSTRACT

Lumber is dried in a kiln by controlling the temperature and humidity of air within the kiln during a first cycle, followed by a second cycle allowing humidity to equalize between the coarse and dense lumber in the kiln without adding further energy. Air recirculates across the lumber in the kilm, and the drop in dry bulb air temperature across the lumber indicates the dryness of the lumber. The air temperature within the kiln is maintained at a predetermined setpoint, but no attempt is made to control the temperature drop across the lumber. Upon reaching a predetermined temperature drop across the lumber, corresponding to a relatively high amount of moisture in the kiln, no further energy is supplied to the kiln and air recirculation continues for a time to allow equalization of moisture in all lumber within the kiln. The process yields a desired uniform amount of moisture in the lumber while avoiding overdrying of the relatively coarse lumber in the kiln.

11 Claims, 5 Drawing Sheets

METHOD AND APPARATUS FOR DRYING LUMBER

FIELD OF THE INVENTION

This invention relates in general to drying green lumber, and relates in particular to an improved method and apparatus for kiln-drying mixed batches of lumber to a uniform dryness without overdrying some of the lumber.

BACKGROUND OF THE INVENTION

So-called "green" or freshly-cut lumber must be seasoned by drying the lumber to reduce the moisture content, before the lumber can be put to use. Although lumber can be dried by exposure to ambient air, that practice usually takes months to accomplish and the results seldom are uniform from one batch of lumber to the next. For these reasons, lumber is usually dried in a kiln where the temperature and relative humidity of the air are regulated in an effort to produce the desired moisture content within the lumber in the shortest possible time. Batches of lumber are stacked within the kiln so as to permit significant air circulation through the stack, and one or more such stacks usually are dried within the kiln at a time.

The charge of lumber in a kiln usually is a mix of dense- and coarse-grain lumber, with the relatively dense lumber containing more moisture and therefore requiring more energy (or greater drying time) to reach the desired moisture content. If the entire charge or batch of lumber is dried to meet the moisture-removal requirements of the dense lumber alone, the coarse-grain boards are ruined by overdrying. On the other hand, drying the entire batch of lumber only to reach the proper moisture content for the coarse-grain boards leaves the relatively dense boards with excess moisture, rendering them unsuitable for use without further drying. Although overdrying can be prevented by maintaining atmospheric conditions within the kiln to dry at a relatively slow rate which eventually produces the desired moisture content in the entire batch of lumber, that technique is unacceptably slow for effective commercial use.

Prior art kilns are known which attempt to deal in various ways with the problems of drying mixed-density batches of lumber. These efforts typically involve attempting to maintain a predetermined drying ability within the kiln by maintaining, for example, a constant wet-bulb temperature depression in the air within the kiln. U.S. patents to Reynolds (U.S. Pat. No. 3,386,183) and to Rosenau (U.S. Pat. No. 4,356,641) seek to control the wet-bulb temperature depression by controlling the heat input to the kiln. Gelineau (U.S. Pat. No. 4,599,808) attempts to maintain a predetermined constant rate of evaporation within a kiln by controlling the dry-bulb temperature drop in air flowing across the lumber, while maintaining a constant wetbulb temperature of the air upstream of the lumber. These efforts of the prior art have proven less than fully satisfactory, resulting either in overdrying the lumber or in drying unnecessarily slowly in an effort to avoid overdrying. To avoid overdrying in many instances, the kiln operator frequently must shut down the kiln long enough to sample the dryness of lumber at several locations within the kiln. These sampling steps, if properly done, can give the operator at least some idea of the additional energy (or drying time) required to reach the desired moisture content throughout the entire batch of lumber in the kiln. This sampling is at best a makeshift and inaccurate expedient, and further increases the overall drying time as the kiln must be shut down one or more times to allow sampling.

SUMMARY OF THE INVENTION

Stated in general terms, the amount of moisture in a batch of lumber being dried according to the present invention is equalized at a desired level by maintaining air within the kiln at a predetermined constant temperature and relative humidity, while varying the air flow across the lumber. The drop in temperature across the lumber is monitored, but is not controlled. When this temperature drop reaches a preset compliance point, no more energy is added to dry the lumber in the kiln. Air flow across the lumber thereafter continues for a further time, with the relatively wet more-dense lumber giving up moisture to the recirculating air and the relatively dry coarse-grained lumber taking on moisture from the air until the amount of moisture in the boards becomes substantially equalized across the entire batch of lumber.

Stated somewhat more particularly, the kiln is divided into two or more zones in which batches of lumber are placed, and through which the air flow is separately controlled. The inlet air dry bulb temperature is controlled in each zone, preferably by regulating the amount of steam flowing into that zone. The relative humidity within the kiln is adjusted by injecting steam and water, or by venting air from the kiln as necessary to maintain a constant wet bulb air temperature within the kiln. Air recirculates past the lumber in each zone by one or more fans separately associated with each zone, and the fans reverse direction at preset times so as to transpose the upstream and downstream sides of the lumber subjected to the recirculating air flow within the zones.

When the actual dry-bulb temperature drop across a particular zone reaches a preset temperature drop known as the compliance value, the air flow in that zone is reduced to a minimum value which prevents additional drying of the lumber in that zone. The other zones continue to dry until they also reach the preset compliance value. The fans for each zone are then reversed and compliance is again achieved with the opposite air flow. Upon reaching total compliance in all zones, the first drying cycle is complete and further heating and humidifying of air within the kiln is limited to the extend required to maintain reduced setpoint temperatures within the kiln and thereby prevent premature cooling; no further energy is added to the lumber, but the fans continue to circulate air across the lumber in each cell. This circulation continues for an equalization time period preselected by the kiln operator, with the direction of air flow being reversed at least once. The humidity within the kiln is relatively high when energy input to the lumber is stopped, preventing overdrying from occurring before the equalization period begins. During the equalization period, the dense boards continue to yield moisture to the recirculating air while the coarse boards absorb moisture from the air. The lumber thus dries to a given percentage of moisture, determined by the wet and dried bulb temperatures within the kiln and the kind of lumber being dried.

Accordingly, it is an object of the present invention to provide an improved kiln for drying green lumber.

It is another object of the present invention to provide a method and apparatus for drying lumber while avoiding overdrying the relatively coarse boards in a batch of lumber.

It is a further object of the present invention to provide a method and apparatus of drying lumber wherein the heat transfer to the lumber is controlled by varying the air flow across the lumber.

Other objects and advantages will become more apparent from the following description of a preferred embodiment.

DESCRIPTION OF PREFERRED EMBODIMENT

Figure 1:
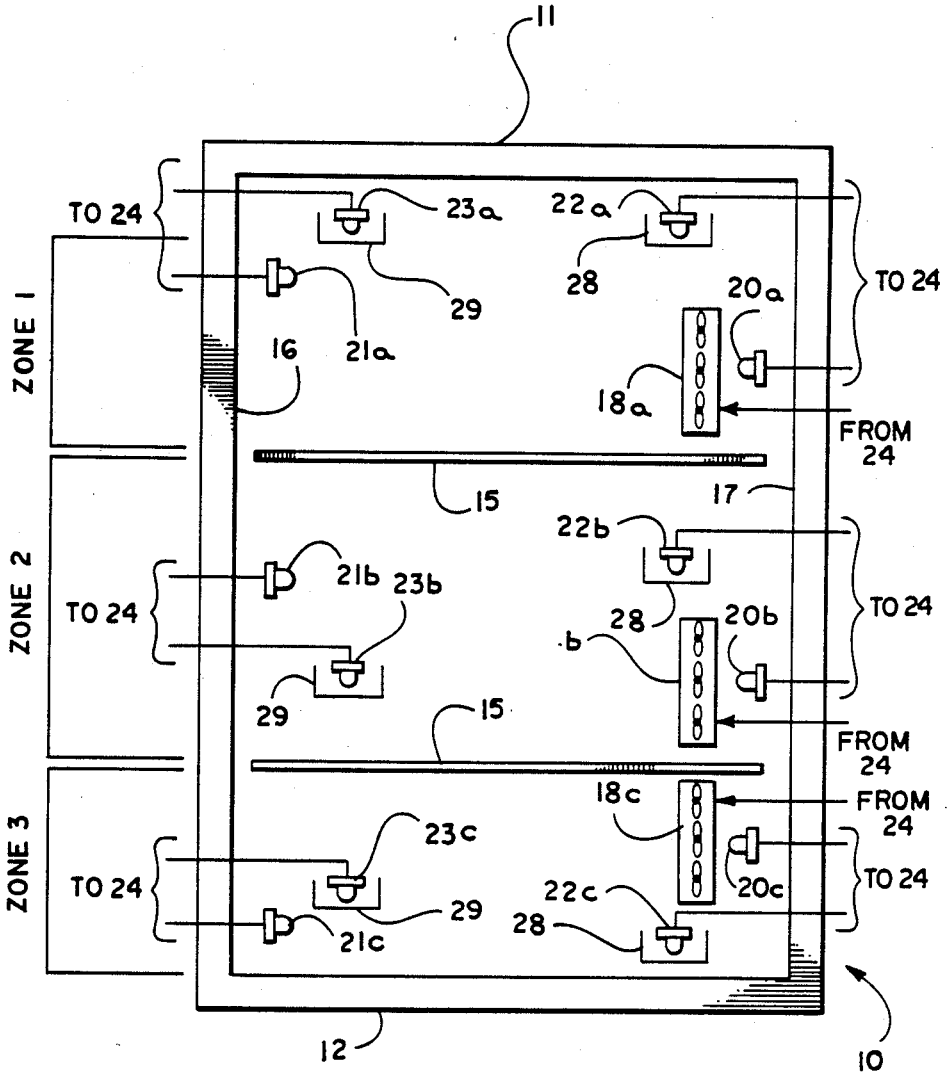
FIG. 1 is a schematic plan view of a kiln according to a preferred embodiment of the present invention.

Turning first to FIG. 1, there is shown generally at 10 a kiln especially adapted for drying lumber according to the present invention. The kiln 10 has portals (not shown) at the entry end 11 for moving green or moist lumber into the kiln, and at the exit end 12 for moving seasoned or dry lumber out of the kiln. The kiln 10 is generally rectangular in plan view, with the longer axis being along the line extending between the entry end 11 and the exit end 12. The interior of the kiln is divided into three zones along the longitudinal axis, the zones appearing on FIG. 1 and identified herein as zone 1, zone 2, and zone 3. It should be understood that the choice of three zones is determined by the size of the kiln and is not considered a critical factor of the present invention.

Each zone within the kiln 10 is defined by removable baffles 15. These baffles may extend fully between the opposite side walls 16 and 17 of the kiln, although the baffles can fall somewhat short of the side walls without significantly detracting from the kiln operation as described herein. However, the baffles 15 should be easily retracted or repositioned within the kiln 10 to permit loading and unloading lumber in the kiln. In this regard, it should be understood that a fresh charge of green lumber typically is loaded at one time into all three zones of the kiln through the portal at the entry end 11; that lumber, once dry, is then removed from all zones through the portal at the exit end 12.

Each zone within the kiln 10 is equipped with selectively reversable fans for recirculating the air within the zones. These fans are denoted as 18*a*, 18*b*, and 18*c* for the three zones. Each group of fans 18*a*--18*c* preferably comprises a plurality of individually-controlled fans, so that the volume of air being recirculated through a particular zone can be reduced from the maximum available air flow by operating fewer than all available fans for that zone. In the specific example discussed herein, the group of fans for each zone has three individual fans for recirculating the air within that zone, but it should be understood that a greater or lesser number of fans may be used. Alternatively, variable-speed fans may be used to obtain the desired variations in the amount of air circulation through each individual zone.

Each zone within the kiln 10 has a separate dry bulb thermometer 20*a*, 20*b*, and 20*c* positioned on the right side of the kiln (as viewed in FIG. 1) for measuring the dry-bulb temperature of air recirculating through the respective zone. The zones likewise have separate dry bulb thermometers 21*a* . . . 21*c* positioned at the left sides of the zones. Moreover, separate wet bulb thermometers 22*a* . . . 22*c* and 23*a* . . . 23*c* are located at the right side and left side, respectively, of each zone within the kiln. The wet bulb thermometers 22*a* . . . 22*c* are associated with the right side of the kiln 10, and are located to sense the wet-bulb temperature of air moving downstream of the lumber. Likewise, the wet bulb thermometers 23*a* . . . 23*c* preferably are positioned at the left-side of the kiln 10, and sense downstream temperature when air flows leftwardly across the lumber in the kiln. Vents 28 and 29 are located in the roof of the kiln and are selectively openable as desired to reduce the relative humidity of air within the kiln by venting moisture-laden air from the kiln. As will become apparent, the vents 28 at the right side of the kiln 10 and the vents 29 on the left side are opened or closed in unison. The design of roof vents for lumber-drying kilns is known to those skilled in the art.

Figure 2:
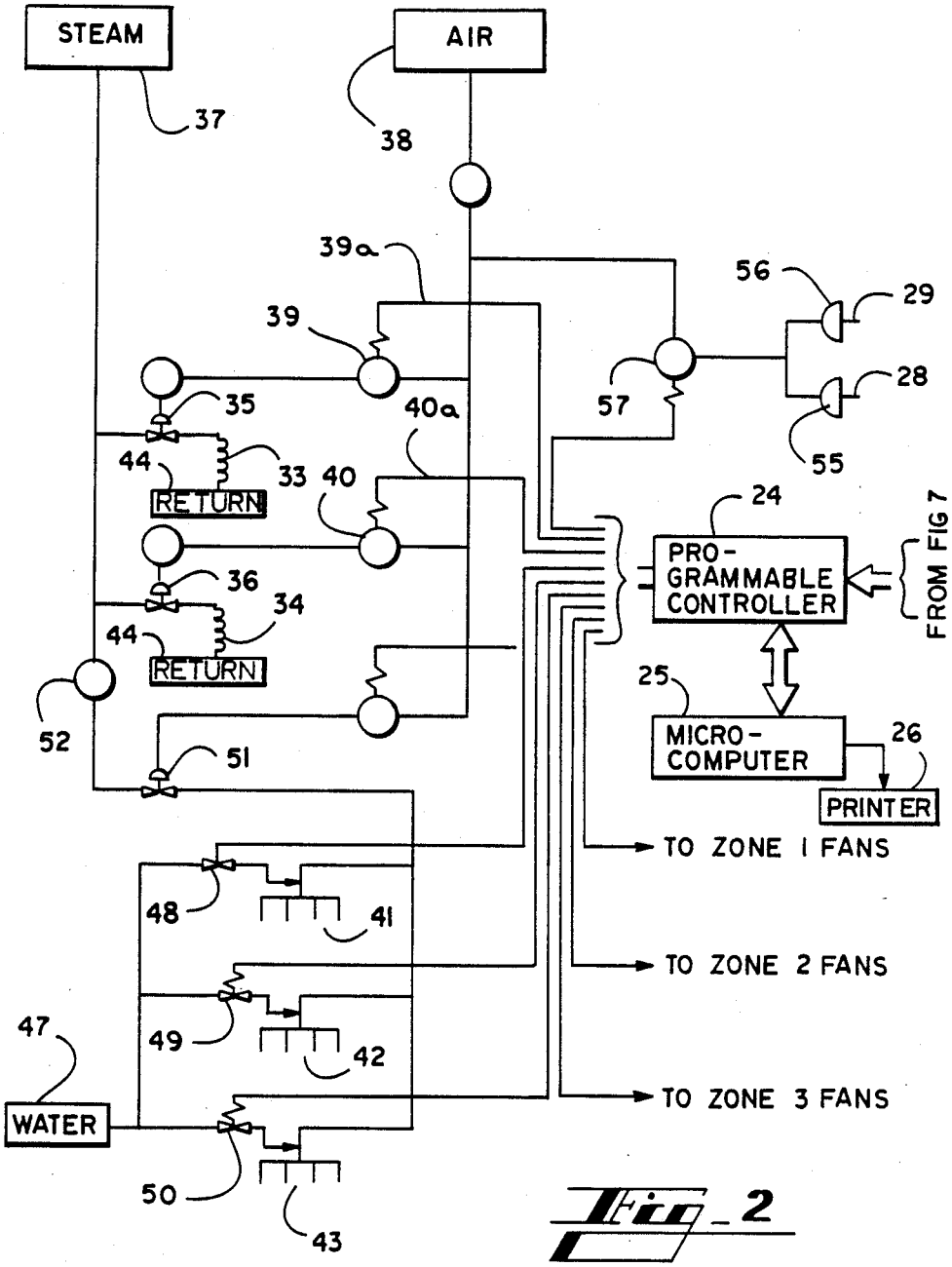
FIG. 2 is a schematic view showing the environmental control apparatus used in the kiln of FIG. 1.

Apparatus for controlling the atmospheric environment within the kiln 10 is shown in FIG. 2. The air within the kiln is heated by two separate steam coils, the center coils 33 located at the center of the kiln and the top coils 34 located at the top thereof, in a manner known to those skilled in the art. Each set of coils is selectively connected to a boiler constituting the steam source 37 through the pneumatically-controlled flow valves 35 and 36, respectively. The flow valves 35 and 36 are operated in response to air pressure from the air source 38, by way of the respective transducers 39 and 40. Those transducers, in turn, receive electrical actuating signals on the lines 39*a*, 40*a* leading to the programmable controller 24. Condensate from the steam coils 33 and 34 is returned to the steam source by the returns 44.

Moisture is selectively added to the air within each zone of the kiln by means of the steam-water sprayers 41, 42, and 43 respectively associated with the three zones within the kiln. The sprayers 41–43 selectively receive conditioning water from the source 47 by way of the solenoid valves 48, 49, and 50, in response to signals received from the programmable controller 24. At the same time, the sprayers may be connected through the pressure reducer 52 and the flow valve 51 to the steam source 37, so that steam emanating from the sprayers is mixed with water in one or more of the sprayers, depending on which of the solenoid valves 48–50 is actuated. The flow valve 51 controlling steam to the sprayers 41–43 is actuated by the programmable controller.

The right roof vents 28 and left roof vents 29 are opened and closed by the air-powered actuators 55 and 56, controlled by the solenoid valve 57 in response to the programmable controller 24.

The programmable controller 24 used in the present embodiment is made by Allen-Bradley Company of Milwaukee, Wisconsin. The programmable controller 24 may connect to a microcomputer 25 to facilitate entry and change of the various operator-selectable parameters. The printer 26 connects to the computer 25 for printing reports of operator parameters and variables such as measured temperatures and operating times for each run of the kiln 10. The nature and operation of such programmable controllers are well known to those of ordinary skill in the art and need not be detailed herein apart from the following description of the process being controlled.

The operation of the present apparatus and method is now discussed with reference to FIG. 3. A charge of green lumber is moved into the kiln 10, and the baffles 15 are positioned to create the three distinct zones for recirculation of air within the kiln. The drying operation takes place in two sequential cycles, and the operator selects certain predetermined parameters for both cycles and enters those parameters into the programmable controller 24 before starting the drying operation. These operating parameters or setpoints include the dry and wet bulb temperatures for the first cycle, the minimum dry bulb temperature drop (dT) across the lumber constituting the "compliance value" selected to constitute the end of the first operating cycle, the minimum dry and wet bulb temperatures for the second cycle, and the equalization time constituting the duration of the second cycle. The nature and purpose of those setpoint values is discussed in greater detail below.

During the first cycle of operation, the air within the kiln is heated and humidified to predetermined setpoint values determined by factors including the kind of lumber being dried and the desired overall drying time commensurate with avoidance of overdrying. Another factor considered by the kiln operator in determining the setpoints is the desired final moisture content of the dried lumber. These factors to some extend are empirically determined, as is known to those skilled in the art.

The compliance point across a zone is reached when the dry bulb temperature drop of air flowing across the lumber in that zone reaches a value determined by the kiln operator to denote a predetermined moisture content of the lumber. The compliance point is separately reached for each zone within the kiln. As the compliance temperature across a zone is reached, the direction of air flow within that zone is then reversed until compliance is again reached across the zone. The air flow is reduced in each zone reaching compliance in both directions, so as to substantially eliminate further drying within that zone until the first cycle of drying is completed. When all zones reach compliance in both directions, the first cycle is complete and further energy input to the lumber is stopped. The second cycle now commences, providing a preset time for the humidity of the lumber within the kiln to equalize. The dT across the lumber is monitored while the dense and coarse boards seek equalization to the same moisture content during the second cycle. During this time the dense boards continue to yield moisture to the atmosphere while the coarse boards absorb moisture from the atmosphere, based on the fact that a board will dry to a given percent moisture for a given set of dry and wet bulb temperatures.

As a specific example of operating setpoints for the kiln according to the present invention, assume the kiln is charged with Southern Yellow Pine lumber. The dry bulb/wet bulb setpoints for the first cycle are 240° F. upstream of the lumber/200° F. downstream, and the kiln commences operation to achieve those setpoints in the atmosphere recirculating through the three zones. The dry bulb temperature drop across each zone is monitored to determine a point that indicates 35% relative humidity within each zone, a relatively high-humidity state corresponding to the compliance dT chosen for the particular lumber. When all zones are in compliance, the second cycle commences and dry bulb/wet bulb temperature setpoints of 150° F. upstream/140° F. downstream are utilized. Temperature and humidity within the kiln are monitored during the second cycle, and heat or moisture is added as needed to maintain the setpoints if the kiln cools too rapidly, e.g., due to rapid heat loss to air outside the kiln. However, it should be understood that no additional energy is supplied to dry the lumber during the second cycle. The equalization time is predetermined to allow all the lumber within the kiln to reach 15% moisture, the desired goal of dry Southern Yellow Pine.

It should be noted that the 15% moisture content goal could be achieved with lower dry bulb/wet bulb temperatures in the first cycle, for example, 150° F./140° F., but reaching a compliance point with such lower temperatures would require weeks rather than hours with the higher first-cycle temperatures noted previously. Those skilled in the art will realize that the dry bulb/wet bulb temperatures can be increased somewhat over the previous figures, provided the compliance point also is raised so as to avoid overdrying the relatively coarse lumber before the setpoint is reached and no further energy is introduced into the kiln to dry the lumber.

Figure 3A:
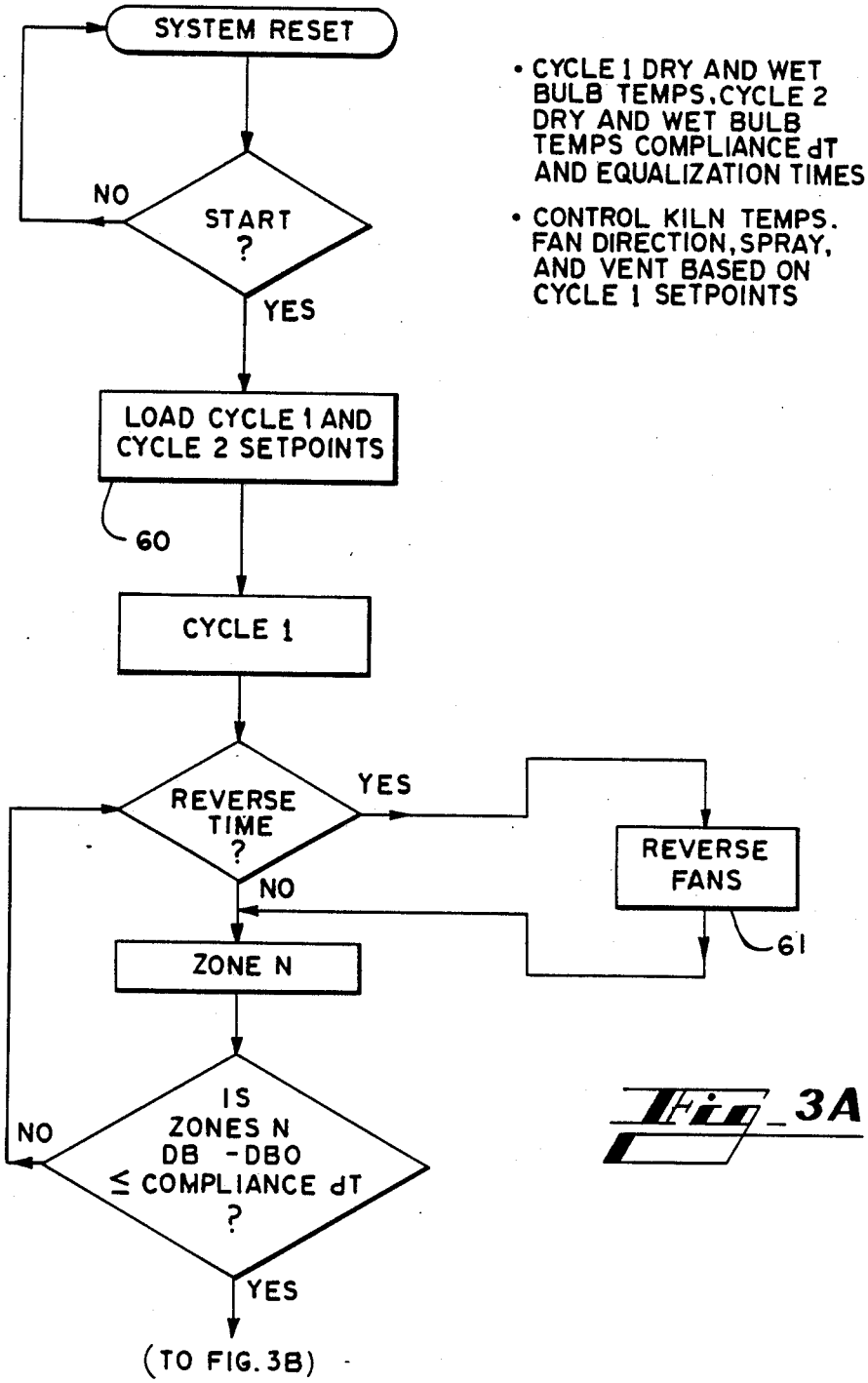
FIG. 3A, 3B, and 3C are flow diagrams illustrating a preferred mode of operating the kiln according to the present invention.
Figure 3B:
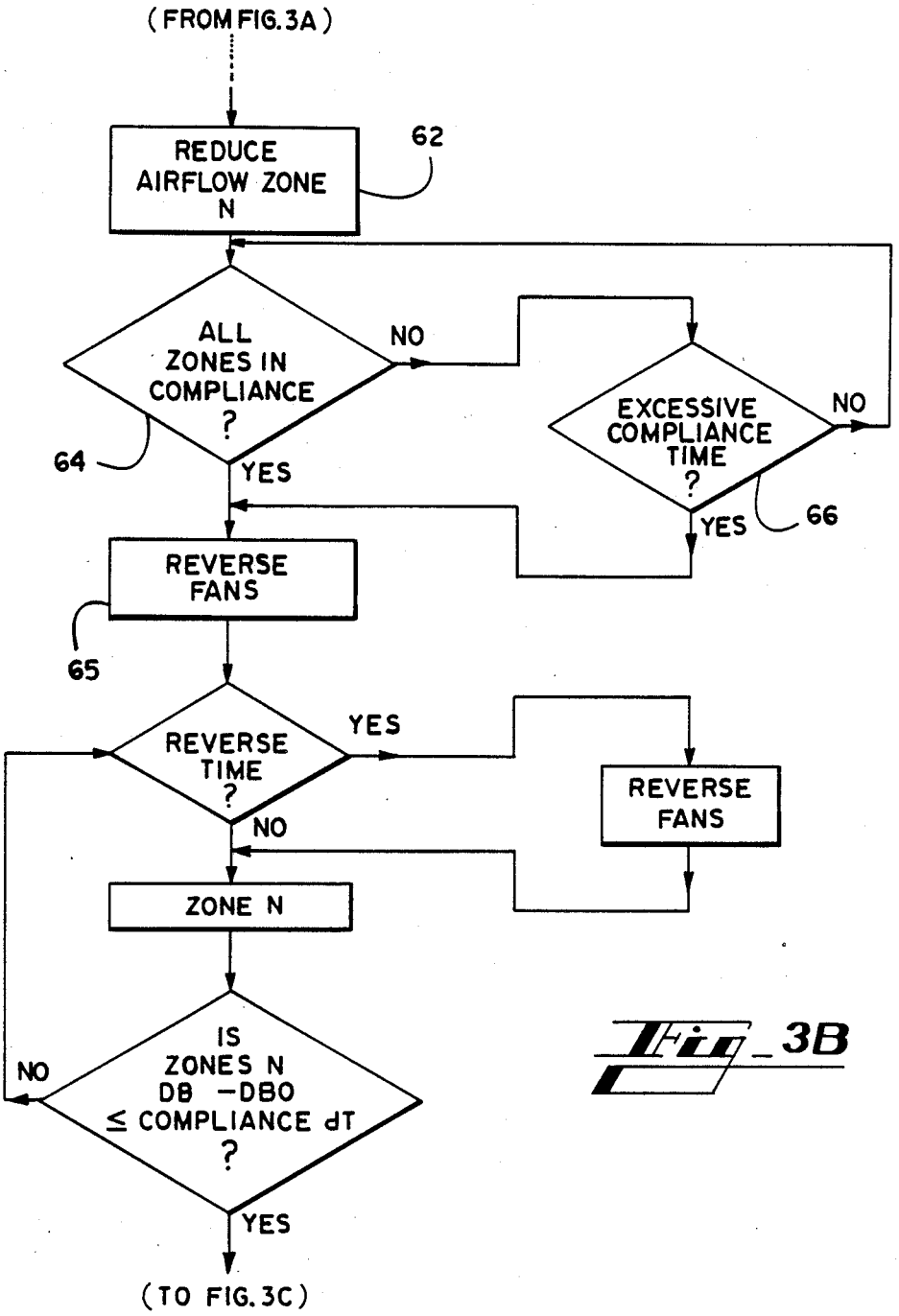
Figure 3C:
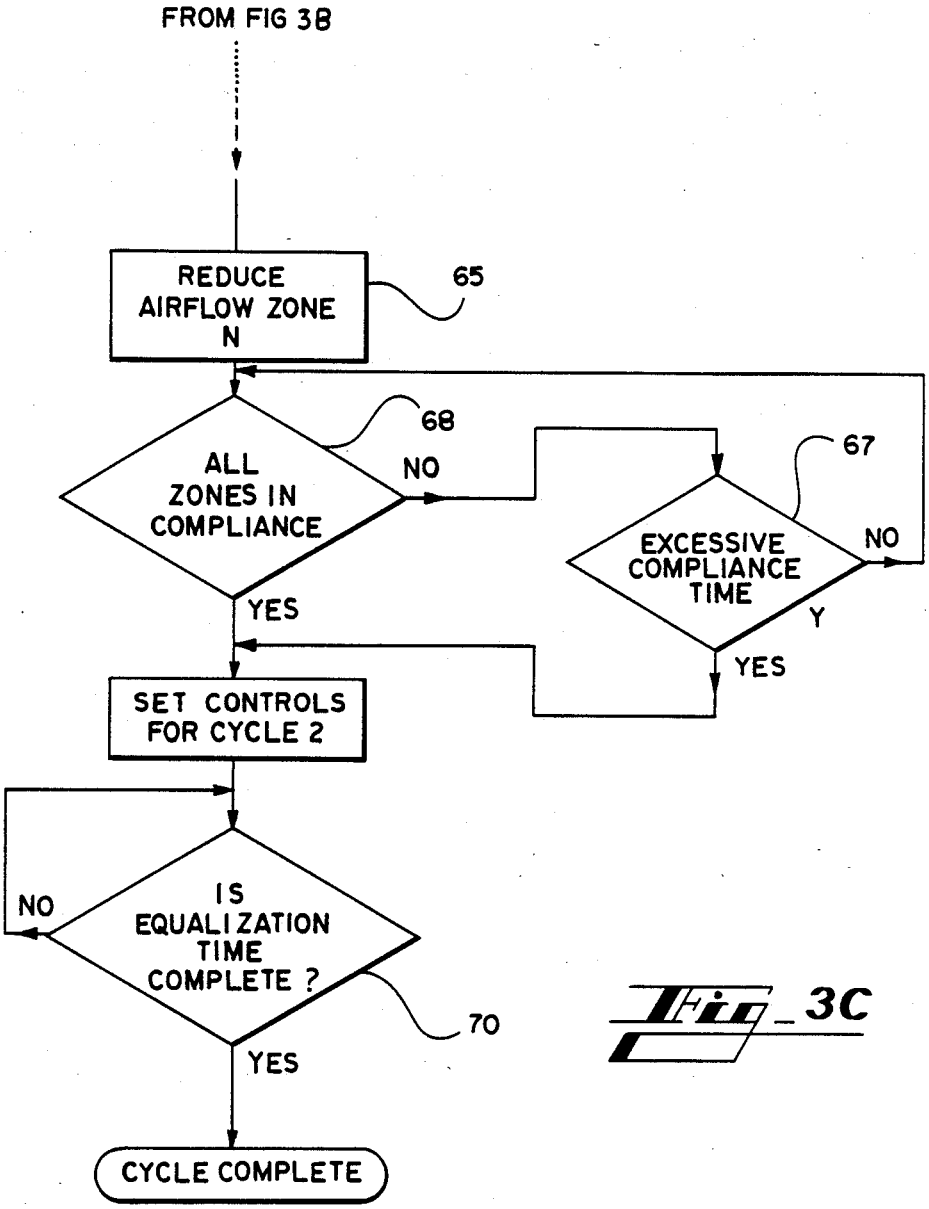

Once the kiln operator selects the various setpoints determined for the lumber being dried, the drying operation is started and the setpoints are loaded into the programmable controller as indicated at step 60 in FIG. 3A. As start-up commences, the programmable controller is instructed to close the vents 28 and 29 and start all the fans of each group of fans **18*a*–18*c* for maximum air flow in a first direction hereafter called the "forward" direction. The steam flow valves 35 and 36 also are opened at this time to commence heating the kiln based on the dry bulb setpoint temperature for the first cycle. The programmable controller preferably is programmed to gradually increase the kiln temperature with a start-up ramp, so as to limit the impact of a cold kiln on the boiler 37. This start-up ramp initially limits the amount of opening for the flow valves 35 and 36, thereby limiting the steam flow to the coils 33 and 35** during the predetermined time of the start-up ramp.

The fans **18*a*–18*c* run forwardly for a preset time during the first cycle, and then automatically reverse direction as indicated at step 61 in FIG. 3A. The amount of time between reversal of the fans is selectable by the kiln operator; three hours is typical for the first cycle of operation. By periodically reversing the direction of air recirculating through each zone, the effect of the relatively warm "upstream" air flowing onto the lumber is equalized across both sides of the lumber stacked in the kiln. This action continues with the programmable controller controlling the kiln temperature using the dry bulb temperature of air upstream of the lumber in each zone, to regulate steam flow within the kiln. The dry bulb thermometer 20*a*–20*c* are selected to measure upstream dry bulb temperature during forward fan operation, and the dry bulb thermometers 21*a*–21*c* are substituted by the programmable controller during reverse-flow operation. The relative humidity within the kiln is regulated by using the wet bulb temperature downstream of each zone, the roof vents being opened as necessary to vent overly-humid air from the kiln. Likewise, a steam/water mixture is introduced through one or more of the sprayers 41 . . . 43** if the monitored wet bulb temperatures indicate the moisture content of air within one or more zones of the kiln has fallen below the setpoint. However, no effort is made to control the temperature drop across a zone.

The programmable controller monitors the actual drop (dT) in dry bulb temperature across each zone. When the temperature drop across one of the zones reaches the preset value of dT, corresponding to the compliance value setpoint discussed above, the air flow in that particular zone is reduced to a minimum value as indicated at 62 in FIG. 3B. Reduction of air flow is accomplished by shutting down one or more of the multiple fans for recirculating the air within that zone. This reduction in air flow prevents additional drying of the lumber in the zone after the compliance value is reached. However, some minimum air flow across that zone is necessary to avoid stagnation of the air within that zone, thereby avoiding localized hot spots which may cause false temperature readings in an adjacent zone within the kiln.

After one of the zones first reaches compliance, the other zones continue to operate at normal fan speed and no further reversal of fan direction takes place until all zones reach the preset compliance value as indicated by the measured dry bulb temperature drops across those zones. This step is indicated at 64 in FIG. 3B. When all the zones have reached the compliance value, the fans for each zone are then reversed as indicated at 65, and all fans again operate to increase the air flow in each zone. Cycle 1 then continues with periodic reversal until compliance across each zone is again achieved with the opposite air flow. As with previous compliance, the air flow in each zone again reaching compliance is reduced as indicated at 65, FIG. 3C. It should be noted that if time in excess of a predetermined value is required for all zones to reach first compliance, the fans are reversed anyway as indicated at 66 in FIG. 3B and the first cycle continues toward the second compliance. Likewise, if a predetermined time passes without all zones being in compliance for the second time as indicated at 68, FIG. 3C, a condition of total compliance is nonetheless determined to exist as indicated at 67. At this time the first cycle of the drying process is complete and the timed second cycle commences.

The second cycle of kiln operation, as discussed above, takes place with no further energy added to the kiln except as required to maintain the minimum setpoints and prevent excessive cooling of the kiln. The lumber within the kiln cools down and the moisture equalizes across the dense and coarse lumber during the equalization time, as previously discussed. The equalization time is preselected by the kiln operator, and during that time the fans in all zones may reverse direction, for example, every hour during that equalization time. When the equalization time is complete as indicated at 70 in FIG. 3C, the second cycle is completed and the kiln is automatically shut down by the programmable controller. The controller may collect data concerning the measured temperatures and relative humidity during the overall drying cycle, and can prepare a printed report of that measured data at the end of the second cycle.

It should be understood that the foregoing relates only to a preferred embodiment of the invention, and that numerous modifications and changes therein may be made without departing from the spirit and scope of the invention as defined in the following claims.

What is claimed is:

1. Method of drying a quantity of green lumber of nonuniform density to a desired level of moisture content, comprising the steps of:

placing a quantity of lumber of nonuniform density into a region;

circulating the air within the region across the quantity of lumber;

adding energy to the region, so as to remove moisture from the lumber;

monitoring the dry bulb temperature drop in air flowing across the lumber without attempting to control that temperature drop, so as to determine the occurrence of a certain temperature drop corresponding to a predetermined compliance point indicative of a moisture content greater than the desired moisture content for the lumber;

in response to reaching the compliance point, discontinuing the addition of drying energy to the circulating air; and thereafter continuing to circulate the air across the lumber while maintaining a temperature set point in the region for a predetermined time to allow equalization of moisture content to the desired dryness for the entire quantity of lumber, whereby the lumber reaches the desired degree of moisture content without overdrying the relatively less-dense lumber.

2. Method of drying a quantity of green lumber of nonuniform density to a desired level of moisture content, comprising the steps of:

placing a quantity of lumber of nonuniform density into a region;

recirculating the air within the region in a predetermined direction across the quantity of lumber;

adding energy to and controlling the relative humidity of the recirculating air so as to maintain a predetermined dry bulb temperature upstream of the lumber and a predetermined relative humidity downstream of the lumber without attempting to control the temperature drop across the quantity of lumber, thereby commencing to dry the lumber;

reversing the direction of air circulation across the quantity of lumber so as to transpose upstream and downstream in relation to the lumber while maintaining a predetermined dry bulb temperature and relative humidity, respectively, upstream and downstream of the lumber;

measuring the temperature drop in air flowing across the lumber to determine when the temperature drop corresponds to a predetermined compliance point indicative of a certain moisture content greater than the desired moisture content for the lumber;

in response to reaching the compliance point, discontinuing the addition of drying heat in the circulating air; and thereafter continuing to circulate the air across the lumber for a predetermined time while the moisture content in the variable density lumber becomes equalized to the desired moisture content for the entire quantity of lumber, whereby the lumber reaches the desired degree of moisture content without overdrying the relatively less-dense lumber.

3. The method as in claim 2, wherein the step of reversing the direction of air circulation occurs a predetermined time after circulation commences.

4. The method as in claim 2, wherein:

the step of measuring temperature drop in air flowing across the lumber comprises comparing the dry bulb temperatures upstream and downstream of the lumber; and the predetermined temperature drop comprises a predetermined difference in dry bulb temperatures measured upstream and downstream of the lumber.

5. The method as in claim 2, comprising the further steps of:

when the predetermined compliance point is first reached, reversing the direction of air then being circulated across the lumber, and then:

measuring the temperature drop in air flowing across the lumber until the temperature drop again corresponds to the compliance point in the reverse direction of air flow; and only then discontinuing the addition of drying head and continuing the air circulation so that the lumber reaches the predetermined degree of moisture content.

6. Method of drying green lumber of mixed density to a desired level of moisture content in a kiln, comprising the steps of:

defining a plurality of distinct air path zones within the kiln;

placing a quantity of green lumber of mixed density in each zone;

circulating the air in a predetermined direction across the lumber in each zone;

heating the circulating air within the kiln to a preset temperature and controlling the relative humidity of the air so as to maintain a predetermined temperature of air flowing upstream of the lumber in each zone and a predetermined relative humidity of the air downstream of the lumber in each zone without controlling the temperature drop across the lumber;

periodically reversing the direction of air circulation across the lumber in each zone, and transposing the upstream and downstream locations while maintaining the preset upstream air temperature and downstream relative humidity;

monitoring the drop in air temperature across each zone to determine when that temperature drop for each zone reaches a predetermined compliance value indicative of a certain moisture content of the lumber in that zone;

when the temperature drop across a zone reaches the compliance value, reducing the circulating air flow in that zone to a minimum value which prevents further drying of the lumber in that zone;

when all zones reach the compliance value, discontinuing the addition of drying heat to the air in the kiln; and then circulating the air across the lumber in each zone at an increased rate for a predetermined time to equalize the moisture content of the lumber in all zones.

7. The method as in claim 6, wherein the compliance value of temperature drop in air flowing across the lumber is chosen to correspond to a moisture content substantially greater than the desired moisture content, and to an amount of heat in the lumber and in the air within the kiln sufficient to equalize the moisture content to the predetermined value within the predetermined time of air circulation after reaching compliance.

8. The method as in claim 6, comprising the further steps of:

when the temperature drop across all zones reaches the compliance value, reversing the direction of air circulation in each zone and increasing the air flow so as to permit further drying of the lumber;

again monitoring the drop in air temperature across each zone to determine when the temperature drops again reach the compliance value; and when the temperature drop across a zone again reaches the compliance value, again reducing the circulating air flow in that zone to a minimum value which prevents further drying of the lumber in that zone; and then when all the zones again reach the compliance value, commencing the steps of discontinuing the addition of drying heat and circulating air in each zone for a predetermined time at the increased rate to equalize the moisture content of lumber in all zones.

9. Apparatus for drying green lumber of mixed density to a desired level of moisture content without overdrying the relatively coarse lumber, comprising:

a kiln defining a space for receiving a quantity of lumber;

means within the kiln for selectively dividing the space within the kiln into a plurality of separate zones for receiving portions of the lumber;

independent fan means associated with each of said zones for selectively varying the air flow within the zones and thereby controlling heat transfer to the lumber in the zones;

drying means associated with the kiln for adding energy to the kiln sufficient to remove moisture from lumber within the zones;

independent means for producing signals indicative of the actual temperature drop across each zone;

programmable control means responsive to said temperature drop signals and having means for storing signals corresponding to a predetermined dry bulb temperature drop across the lumber and indicative of a certain compliance level of dryness in excess of the desired dryness of the lumber;

the programmable control means being responsive to the difference between said compliance-level temperature signal and said signals for each zone for producing a separate compliance signal for each zone when the actual temperature drop across that zone is equal to the compliance level predetermined temperature drop; and the programmable control means, in response to compliance signals for all the zones, controls the drying means so as to add no more drying energy to the kiln and controls the fan means to maintain air flow in all zones for a predetermined time to equalize the moisture content of the lumber in all zones to the desired level of moisture content.

10. Apparatus as in claim 9, wherein:

the programmable control means is responsive to said compliance signal for a particular zone to control the fan means associated with that zone so as to reduce the air flow therein not to exceed a minimum flow which prevents further drying of the lumber in the zone; and the programmable control means is responsive to compliance signals for all the zones to control the fan means so as to increase the air flow in all zones to a flow which transfers moisture from the relatively dense lumber to the air and transfers moisture from said air to the relatively coarse lumber for a predetermined time while controlling the drying means to add no more drying energy to the kiln, thereby equalizing the dryness of the coarser and denser lumber in all zones.

11. Apparatus as in claim 10, wherein:

said programmable control means produces a compliance signal for each zone independently of the other zones when the temperature drop signal for that zone gears a certain relation to said compliance level.

* * * * *